US011680441B2

(12) United States Patent
Franson et al.

(10) Patent No.: US 11,680,441 B2
(45) Date of Patent: Jun. 20, 2023

(54) VENTED PROTECTIVE PANEL FOR GLAZING

(71) Applicant: Window Film Depot, Inc., Marietta, GA (US)

(72) Inventors: Jeffrey Franson, Marietta, GA (US); Ian Bannister, Marietta, GA (US); Thomas Moore, Sumner, WA (US)

(73) Assignee: Impact Security, LLC, Marietta, GA (US)

( * ) Notice: Subject to any disclaimer, the term of this patent is extended or adjusted under 35 U.S.C. 154(b) by 309 days.

(21) Appl. No.: 17/066,788

(22) Filed: Oct. 9, 2020

(65) Prior Publication Data

US 2022/0112762 A1 Apr. 14, 2022

(51) Int. Cl.

| | |
|---|---|
| ***E06B 3/28*** | (2006.01) |
| ***E06B 7/12*** | (2006.01) |
| ***E06B 3/64*** | (2006.01) |

(52) U.S. Cl.

CPC ..... *E06B 3/28* (2013.01); *E06B 3/64* (2013.01); *E06B 7/12* (2013.01)

(58) Field of Classification Search

CPC ..... E06B 3/28; E06B 3/64; E06B 7/12
USPC ..... 52/203
See application file for complete search history.

(56) References Cited

U.S. PATENT DOCUMENTS

| | | | | |
|---|---|---|---|---|
| 3,686,795 | A * | 8/1972 | La Barge | E06B 7/12 49/504 |
| 4,215,517 | A * | 8/1980 | Everson | E06B 3/28 52/800.16 |
| 6,357,186 | B1 | 3/2002 | Gould | |
| 7,270,600 | B2 | 9/2007 | Kim et al. | |
| 7,490,445 | B2 * | 2/2009 | Steffek | E06B 3/6604 52/456 |
| 7,607,267 | B2 | 10/2009 | Fulton et al. | |

(Continued)

FOREIGN PATENT DOCUMENTS

| | | | |
|---|---|---|---|
| DE | 7701569 | U1 | 6/1977 |
| EP | 2873797 | B1 | 10/2017 |
| WO | WO 2004/009946 | A1 | 1/2004 |

OTHER PUBLICATIONS

WIPO: "Notification of Transmittal of International Search Report and Written Opinion of the International Searching Authority, or the Declaration"; dated Jan. 10, 2022; International Search Report in related PCT Case PCT/US21/51088.

*Primary Examiner* — Brian E Glessner
*Assistant Examiner* — James J Buckle, Jr.
(74) *Attorney, Agent, or Firm* — Bryan W. Bockhop; Bockhop Intellectual Property Law, LLC

(57) ABSTRACT

A security unit protects a glazing unit supported by a window frame The window frame defines a void that is in communication with an air space through external air vents. The window frame has a side panel that defines side panel holes. The security unit includes a security panel that is spaced apart from the glazing unit to define an air cavity and is secured to a vertical tubular bar that is secured to a side panel of the window frame. The vertical tubular bar defines a passage therethrough in communication with the air cavity through air cavity vents and defines passage holes aligned the side panel holes. Air circulates from the air cavity to the air space through the air cavity vents, the passage holes, the side panel holes and external air vents.

17 Claims, 4 Drawing Sheets

(56) References Cited

U.S. PATENT DOCUMENTS

| | | | | |
|---|---|---|---|---|
| 7,739,851 | B2 * | 6/2010 | Davis | E06B 3/67308 52/656.9 |
| 7,765,769 | B2 * | 8/2010 | Rosskamp | E06B 3/677 52/204.6 |
| 7,827,761 | B2 * | 11/2010 | Buchanan | E06B 3/677 52/786.13 |
| 8,800,221 | B1 | 8/2014 | Header | |
| 9,790,735 | B2 | 10/2017 | Trott | |
| 10,450,793 | B2 | 10/2019 | Campbell | |
| 2005/0072076 | A1 | 4/2005 | Fulton et al. | |
| 2006/0286317 | A1 * | 12/2006 | Berkowitz | E06B 3/5418 428/34 |
| 2010/0281797 | A1 | 11/2010 | Yun | |
| 2016/0145934 | A1 | 5/2016 | Trott | |
| 2017/0342765 | A1 | 11/2017 | Lee et al. | |
| 2018/0320433 | A1 * | 11/2018 | Ting | E06B 3/6715 |
| 2021/0230933 | A1 * | 7/2021 | Hodges | E06B 3/64 |

* cited by examiner

VENTED PROTECTIVE PANEL FOR GLAZING

BACKGROUND OF THE INVENTION

1. Field of the Invention

The present invention relates to protective panels for glazing systems and, more specifically, to a protective panel system that vents air from a cavity defined between a protective panel and a glazing unit.

2. Description of the Related Art

Glazing systems typically include one or more glass panes that are secured to a window opening by a frame. The typical frame used in commercial glazing includes a hollow bracket (which can include a combination of structures), which is secured to the window opening. The aluminum bracket holds the glass panes between a pair of aluminum glazing legs and elongated rubber gaskets that seal the panes to the glazing legs.

Security panels are often applied to glazing systems for such purposes as preventing forced entry and damage due to vandalism. There is a high demand for security panels being installed on storefront glazing systems and at other vulnerable sites. Such security panels frequently include polycarbonate sheets that are secured to a spacer that is secured to the window frame.

In a typical system, humidity can build up in the space between the security panel and the glass pane, which can cause unsightly fogging of the pane and the security panel. To reduce such fogging, installers often drill holes through the spacer so that the cavity is in communication with the outside air. However, on humid days, the air in the cavity can has outside humidity that can condense on the glass panes as a result of cooler inside temperatures due to air conditioning.

Therefore, there is a need for a security panel system that vents air from the cavity between the glass panes and the security panel to a space of controlled temperature and humidity.

SUMMARY OF THE INVENTION

The disadvantages of the prior art are overcome by the present invention which, in one aspect, is a security unit for protecting a window supported by a window frame that defines a void therein and that has a front panel and a side panel. The void is in communication with an air space through a plurality of external air vents in the front panel. The side panel defines a plurality of side panel holes. The window frame supports at least one glazing unit. The air space has an external air humidity, the security unit includes a security panel that is spaced apart from the glazing unit so as to define an air cavity there-between. The air cavity has an air cavity humidity. The security panel is secured to a first vertical tubular bar, which is disposed in the air cavity and is secured to the side panel of the window frame. The vertical tubular bar defines a passage therethrough that is in communication with the air cavity through a plurality of air cavity vents. The vertical tubular bar defines a plurality of passage holes that are each aligned with a different one of the plurality of side panel holes so that the passage is in communication with the void therethrough. Air circulates from the air cavity to the air space through the plurality of air cavity vents, the plurality of passage holes, the plurality of side panel holes and the plurality of external air vents, thereby maintaining the air cavity humidity at the external air humidity.

In another aspect, the invention is a window unit that is adjacent to an air space having an external air humidity. The window unit includes a window frame that defines a void therein and that has a front panel and side panel. The void is in communication with the air space through a plurality of external air vents in the front panel. The side panel defines a plurality of side panel holes. At least one glazing unit is supported by the window frame. A security panel is spaced apart from the glazing unit and defines an air cavity there-between that has an air cavity humidity. A rectangular securing structure is affixed to the window frame. The security panel is affixed to the rectangular securing structure. The rectangular securing structure includes a rectangular first vertical tubular bar, an oppositely disposed rectangular second vertical tubular bar, a rectangular bottom tubular bar and an oppositely disposed rectangular top tubular bar. The rectangular securing structure is disposed in the air cavity. At least one of the first vertical tubular bar and the second vertical tubular bar defines a passage therethrough that is in communication with the air cavity through a plurality of air cavity vents and defines a plurality of passage holes that are each aligned with a different one of the plurality of side panel holes so that the passage is in communication with the void therethrough. As a result, air circulates from the air cavity to the air space through the plurality of air cavity vents, the plurality of passage holes, the plurality of side panel holes and the plurality of external air vents, thereby maintaining the air cavity humidity at the external air humidity.

In yet another aspect, the invention is a method of installing a security panel onto a window frame that supports a glazing unit in which a cavity is defined between the security panel and the glazing unit. A plurality of vertical bar air vents is drilled through an interior side a vertical rectangular bar of a securing structure. A plurality of passage holes is drilled through a peripheral side of the vertical rectangular bar. A plurality of side panel holes is drilled through a side panel of the window frame so that each of the plurality of side panel holes is in alignment with a different one of the plurality of passage holes when the vertical rectangular bar is secured to the side panel. The securing structure is secured to the window frame. The security panel is secured to the securing structure. External air vents are drilled in a front panel of the window frame so that the cavity is in fluid communication with the air vents through the passage holes and the side panel holes.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
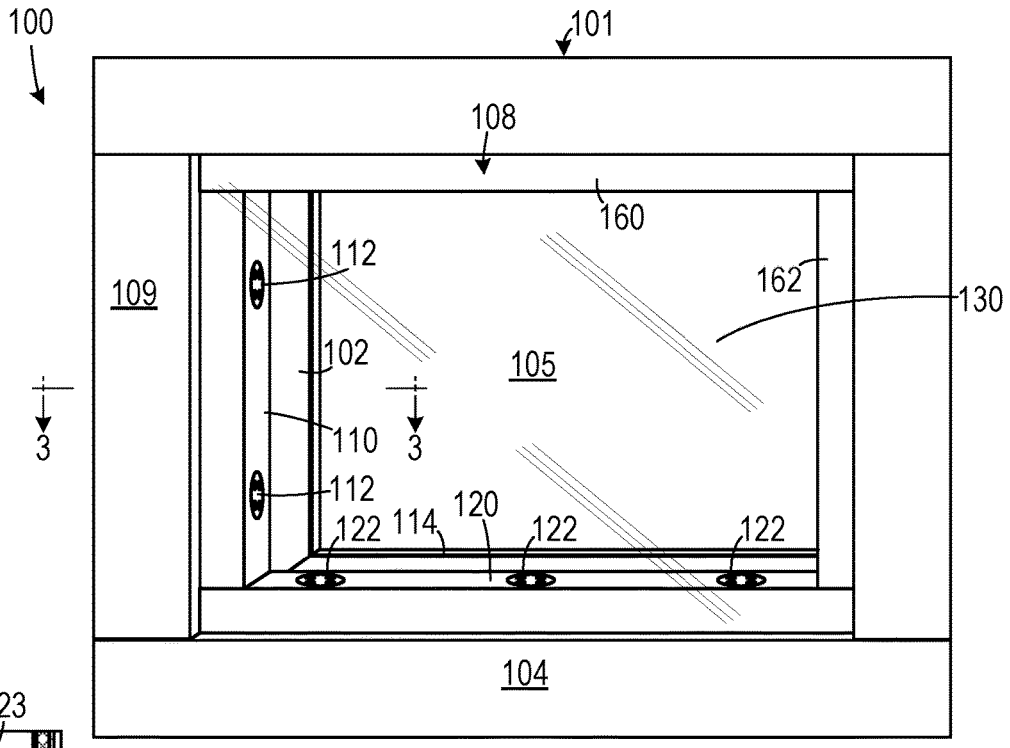
FIG. 1 is a front perspective view of one representative embodiment of a vented glazing security unit.
Figure 2A:
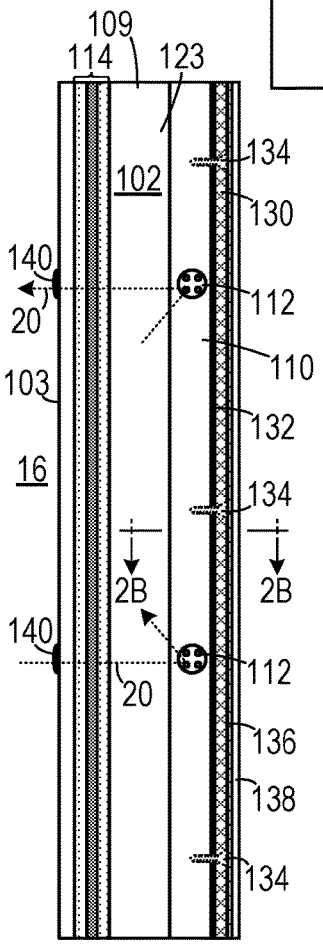
FIG. 2A is a schematic view of the vented glazing security unit looking at a bar affixed to a window frame.
Figure 2B:
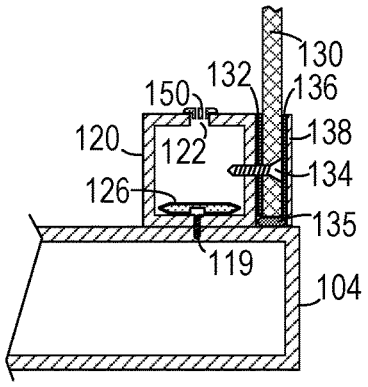
FIG. 2B is a detail showing the bottom tubular bar secured to the window frame and the security panel secured to the bottom tubular bar.
Figure 3:
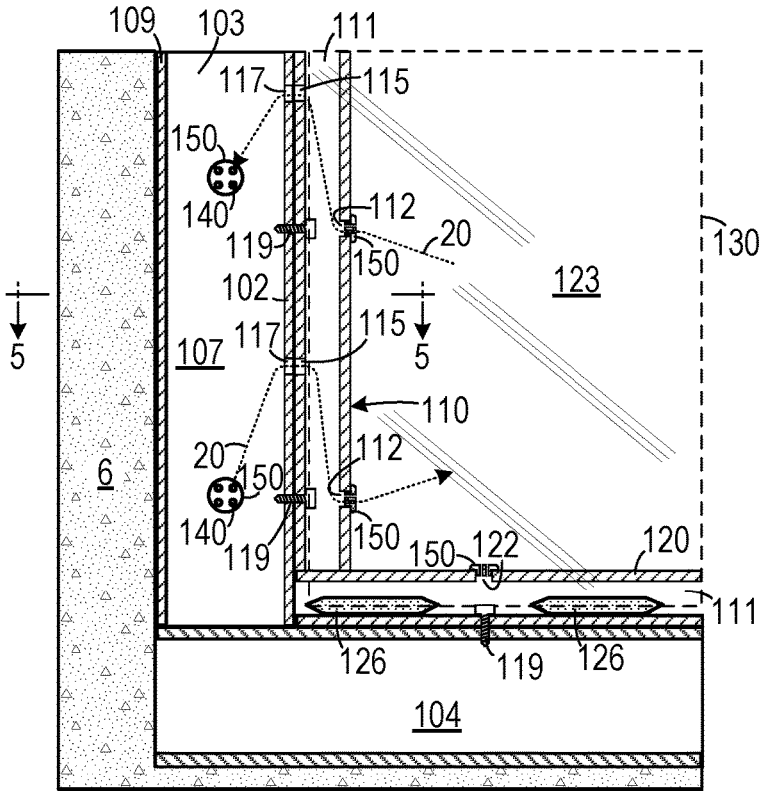
FIG. 3 is a cross-sectional view of a portion of the vented glazing security unit shown in FIG. 1 taken along line 3-3 and viewed from the exterior of the glazing unit.
Figure 4:
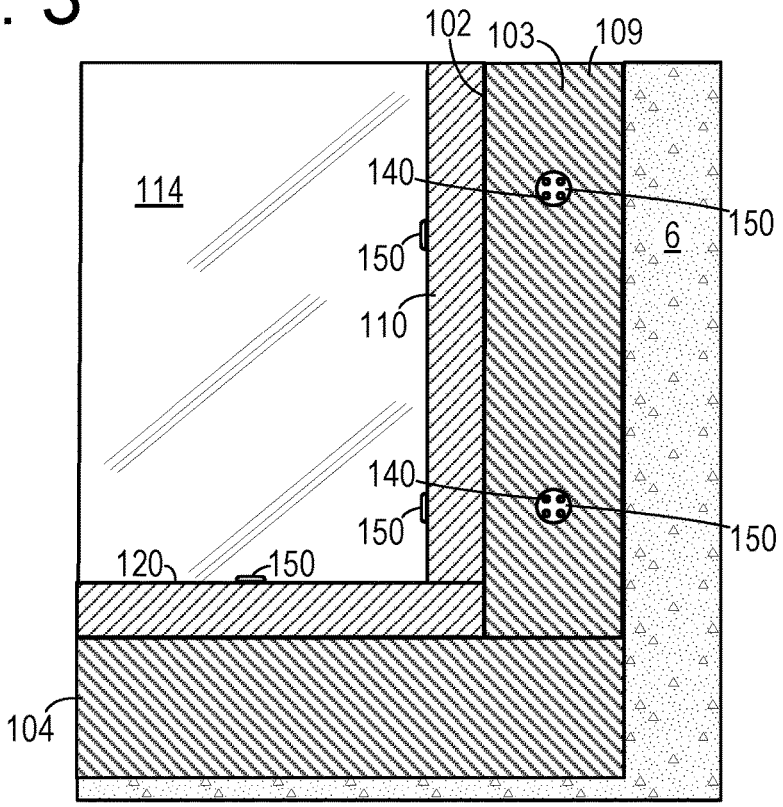
FIG. 4 is an elevational view of the portion of the vented glazing security unit shown in FIG. 3 and viewed from the interior of the glazing unit.
Figure 5:
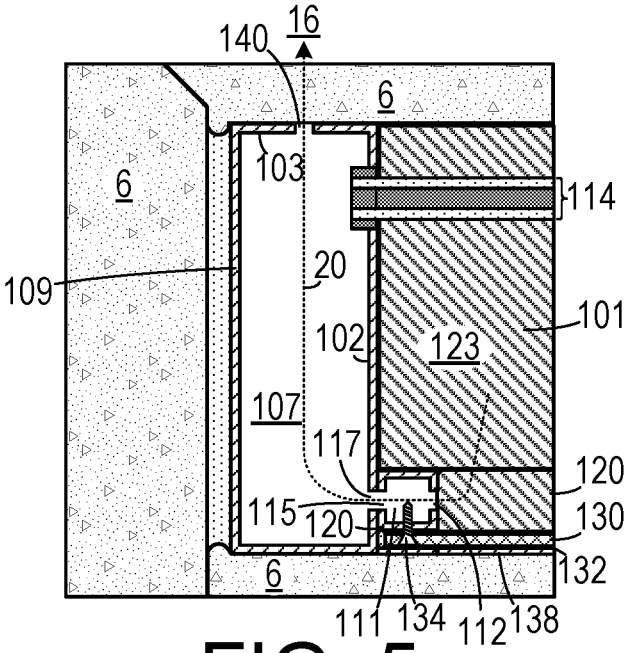
FIG. 5 is a cross-sectional view of a vertical bar and vertical portion of a window frame shown in FIG. 5 taken along line 5-5.

A preferred embodiment of the invention is now described in detail. Referring to the drawings, like numbers indicate like parts throughout the views. Unless otherwise specifically indicated in the disclosure that follows, the drawings are not necessarily drawn to scale. The present disclosure should in no way be limited to the exemplary implementations and techniques illustrated in the drawings and described below. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIGS. 1-5, one embodiment of a security unit 100 for protecting a window 105 includes a security panel 130 and a rectangular securing structure 108 that is affixed to the window frame 101 (that is mounted to a window portal 6) and to which the security panel 130 is affixed. The window 105 includes at least one glazing unit 114 that is supported by a window frame 101 (a double pane glazing unit 114 is shown). The security panel 130 is spaced apart from the glazing unit 114 so that an air cavity 123 is defined by the security panel 130 and the glazing unit 114.

The rectangular securing structure 108 includes a rectangular first vertical tubular bar 110, an oppositely disposed rectangular second vertical tubular bar 162, a rectangular bottom tubular bar 120 and an oppositely disposed rectangular top tubular bar 160. In certain embodiments, the bars in the rectangular securing structure 108 can have cross sectional shape other than rectangular. The bars can include extruded aluminum or other materials such as steel, composites, etc. The rectangular securing structure 108 is affixed to the window frame 101 with a plurality of fasteners, such as sheet metal screws 119. Other affixing devices can be used without departing from the scope of the invention.

The security panel 130 is typically made from a transparent shatter-proof panel, such as a high optic architectural grade polycarbonate sheet (for example, Tuffak® GP, available from Plaskolite, Inc. 400 W. Nationwide Blvd., Suite 400, Columbus, Ohio 43215). Typical polycarbonate sheet widths to prevent forced entry are in the range from ¼ inches to ⅜ inches and widths greater than 1 inches can be used in applications such as bullet-proofing. The security panel 130 is secured to the bars of the securing structure 108 initially with two-sided tape 132 that adheres both to the bars and to the periphery of the security panel 130. Counter-sunk screws 134 are then driven through the security panel 130 into securing structure 108.

The window frame 101 defines a void 107 therein. The window frame 101 has a vertical portion 109 with at least a front panel 103 and a side panel 102 (typically it will include a rectangle of units that each have a prismatic rectangular shape). The void 107 is in communication with an air space 16 through a plurality of external air vents 140 in the front panel 103 that are each drilled through the window frame 101. (In typical embodiments, the air space 16 is the interior of a store, an office or the like. However, in certain embodiments, the air space 16 is outside air.) While the window frame 101 is simplified herein as including rectangular prismatic sections, many other configurations of window frames are known to the art and the present invention can be adapted for use with any such frame that defines a void therein.

The side panel 102 defines a plurality of side panel holes 117 passing therethrough. At least one of the rectangular first vertical tubular bar 110 or the rectangular second vertical tubular bar 162 (and typically both) defines an elongated passage 111 therethrough that is in communication with the air cavity 123 through a plurality of air cavity vents 112 (also referred to as "Moore Vents"). The first vertical tubular bar 110 also defines a plurality of passage holes 115 that are each aligned with a different one of the plurality of side panel holes 117 so that the passage 111 is in communication with the void 107. Air 20 is able to circulate from the air cavity 123 to the air space 16 through the plurality of air cavity vents 112, the plurality of passage holes 115, the plurality of side panel holes 117 and the plurality of external air vents 140, thereby maintaining the air cavity temperature humidity at the external air temperature humidity of the air space 16. To ensure adequate air flow, the plurality of external air vents 140, the plurality of side panel holes 117, the plurality of air cavity vents 112 and the plurality of passage holes 115 each should have a combined area of at least one half square inch per 60 cubic inches of volume in the air cavity. Decorative vent covers 150 can be placed over the vents 112, 122 and 140 to provide a more aesthetic appearance. When such covers 150 are used, it is important to ensure that the total vent hole area of the covers 150 meet the criteria mentioned above.

In some embodiments, the bottom tubular bar 120 also defines an elongated passage 111 into which desiccant packets 126 are placed to absorb moisture during installation. This bar 120 is not vented into the bottom portion 104 of the window frame 101. At least one bottom bar vent 122 is drilled through the bottom bar 120 so that the desiccant 126 is in fluid communication with the air cavity 123 to absorb moisture during installation.

The security panel 130 can be secured to the securing structure 108 initially with a two-sided tape 132. A plurality of counter-sunk screws 134 can be driven through the security panel 130 into the securing structure 108 to provide additional securing force. A structural sealant caulk 135 can provide additional securing force and ensure that the security panel 130 has an airtight seal with the securing structure 108. (Examples of suitable structural caulk include Dow 995, Dow 795 and Dow 999-A.) A trim tab 138 can be affixed to the security panel 130 so as to cover the plurality of counter-sunk screws 134, so as to prevent tampering therewith and to provide a more aesthetic appearance.

Figure 6A:
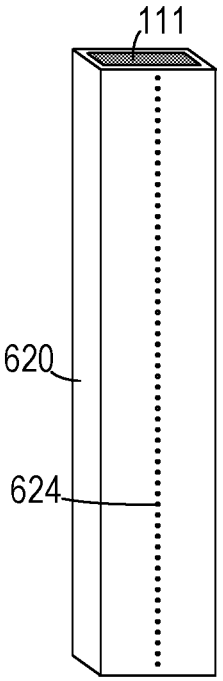
FIG. 6A is a perspective view of a square tubular bar that includes a perforated side.
Figure 6B:
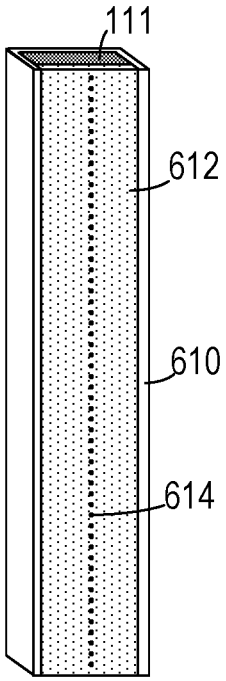
FIG. 6B is a perspective view of a U-channel bar with a perforated cap.

As shown in FIG. 6A, the bar 620 can include a line of perforations 624 drilled therethrough to act as vents. As shown in FIG. 6B, the bar 610 can be a U-shaped bar ("U-channel bar") with an elongated snap-on cap 612 that defines a plurality of perforations 614 therethrough.

Figure 7A:
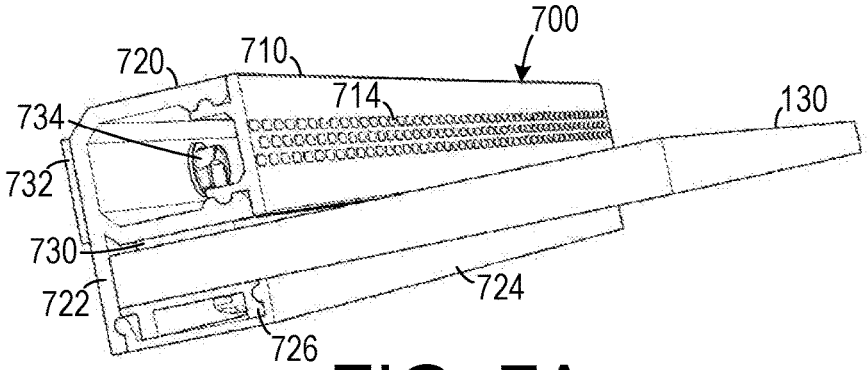
FIG. 7A is a first perspective view of one embodiment of a window security unit employing a U-channel bar with a perforated cap.
Figure 7B:
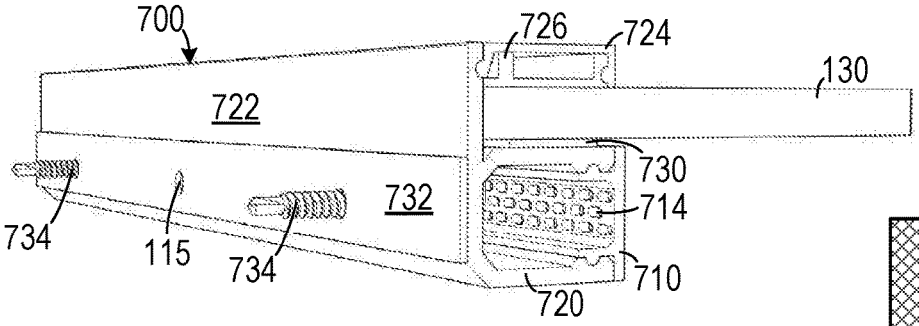
FIG. 7B is a second perspective view of the embodiment shown in FIG. 7A.
Figure 7C:
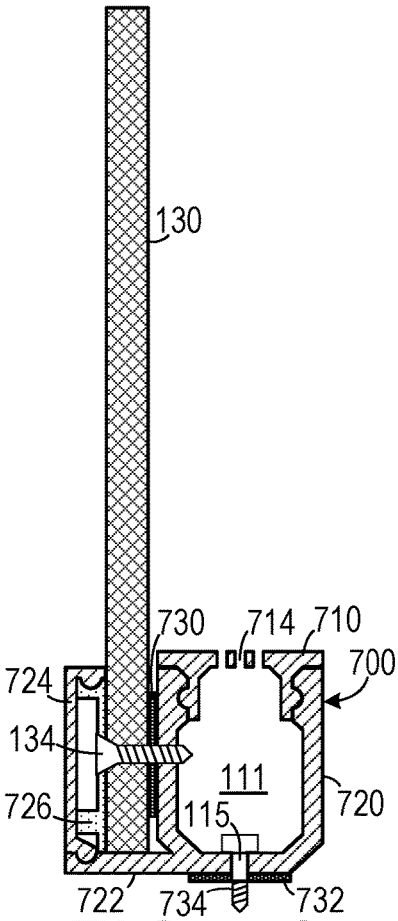
FIG. 7C is a cross-sectional view of the embodiment shown in FIG. 7A.

One example of an easy to install and attractive unit 700 is shown in FIGS. 7A-7C. This unit 700 includes a U-channel bar 720 with an integrated leg member 722 extending outwardly from the side that is secured to the window frame. A vented cap 710 that defines a plurality of holes 714 passing therethrough snaps onto the U-channel bar 720 after it has been secured to the window frame with two-sided tape 732 and screws 734. The security panel 130 is secured to the U-channel bar 720 with two-sided tape 730 and a plurality of screws 134. A bracket 726 is secured to the periphery of the security panel 130 with a plurality of screws 134. A cover 724 is then snapped onto the leg member 722 and the bracket 726 to hide the screws 134.

While in one embodiment, the air cavity is vented to the interior of a building, in certain embodiments the air cavity is vented to the outside. In certain embodiments, security units can be installed inside the glazing and in certain embodiments security units can be installed on both sides of the glazing.

Although specific advantages have been enumerated above, various embodiments may include some, none, or all of the enumerated advantages. Other technical advantages may become readily apparent to one of ordinary skill in the art after review of the following figures and description. It is understood that, although exemplary embodiments are illustrated in the figures and described below, the principles of the present disclosure may be implemented using any number of techniques, whether currently known or not. Modifications, additions, or omissions may be made to the systems, apparatuses, and methods described herein without departing from the scope of the invention. The components of the systems and apparatuses may be integrated or separated. The operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. It is intended that the claims and claim elements recited below do not invoke 35 U.S.C. § 112(f) unless the words "means for" or "step for" are explicitly used in the particular claim. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A security unit for protecting a window supported by a window frame that defines a void therein and that has a front panel and a side panel, the void in communication with an air space through a plurality of external air vents in the front panel, and the side panel defining a plurality of side panel holes, the window frame supporting at least one glazing unit, the air space having an external air humidity, the security unit comprising:

(a) a security panel spaced apart from the glazing unit and defining an air cavity there-between that has an air cavity humidity; and (b) a first vertical tubular bar, to which the security panel is secured, that is disposed in the air cavity and that is secured to the side panel of the window frame, the first vertical tubular bar defining a passage therethrough that is in communication with the air cavity through a plurality of air cavity vents, the first vertical tubular bar defining a plurality of passage holes that are each aligned with a different one of the plurality of side panel holes so that the passage is in communication with the void therethrough, wherein air circulates from the air cavity to the air space through the plurality of air cavity vents, the plurality of passage holes, the plurality of side panel holes and the plurality of external air vents, thereby maintaining the air cavity humidity at the external air humidity.

2. The security unit of claim 1, wherein the plurality of external air vents has a combined area of at least one half square inch per 60 cubic inches of volume in the air cavity, and wherein the plurality of side panel holes, has a combined area of at least one half square inch per 60 cubic inches of volume in the air cavity, and wherein the plurality of air cavity vents, has a combined area of at least one half square inch per 60 cubic inches of volume in the air cavity, and wherein the plurality of passage holes has a combined area of at least one half square inch per 60 cubic inches of volume in the air cavity.

3. The security unit of claim 1, wherein the security panel comprises a high optic architectural grade polycarbonate sheet.

4. The security unit of claim 1, further comprising:

(a) a second vertical tubular bar;

(b) a bottom tubular bar; and (c) a top tubular bar, wherein the first vertical tubular bar, the second vertical tubular bar, the bottom tubular bar and the top tubular bar are disposed so as to form a rectangular securing structure that is affixed to the window frame.

5. The security unit of claim 4, wherein the first vertical tubular bar, the second vertical tubular bar, the bottom tubular bar and the top tubular bar each comprises a rectangular tubular bar.

6. The security unit of claim 4, wherein the security panel is secured to the rectangular securing structure by:

(a) a two-sided tape;

(b) a plurality of counter-sunk screws; and (c) a structural sealant caulk.

7. The security unit of claim 6, further comprising a trim tab that is affixed to the security panel so as to cover the plurality of counter-sunk screws.

8. The security unit of claim 4, further comprising a desiccant that is disposed in the bottom tubular bar and wherein the bottom tubular bar defines at least one bottom bar vent so that the desiccant is in fluid communication with the air cavity.

9. The security unit of claim 1, wherein at least one of the plurality of external air vents and the plurality of air cavity vents comprises a line of perforations.

10. The security unit of claim 1, further comprising a plurality of decorative covers that cover each of the plurality of external air vents and each of the plurality of air cavity vents.

11. A window unit adjacent to an air space having an external air humidity, the window unit comprising:

(a) a window frame that defines a void therein and that has a front panel and side panel, the void in communication with the air space through a plurality of external air vents in the front panel, and the side panel defining a plurality of side panel holes;

(b) at least one glazing unit supported by the window frame;

(c) a security panel spaced apart from the glazing unit and defining an air cavity there-between that has an air cavity humidity; and (d) a rectangular securing structure that is affixed to the window frame and to which the security panel is affixed, the rectangular securing structure including a rectangular first vertical tubular bar, an oppositely disposed rectangular second vertical tubular bar, a rectangular bottom tubular bar and an oppositely disposed rectangular top tubular bar, the rectangular securing structure disposed in the air cavity, at least one of the first vertical tubular bar and the second vertical tubular bar defining a passage therethrough that is in communication with the air cavity through a plurality of air cavity vents and defining a plurality of passage holes that are each aligned with a different one of the plurality of side panel holes so that the passage is in communication with the void therethrough, so that air circulates from the air cavity to the air space through the plurality of air cavity vents, the plurality of passage holes, the plurality of side panel holes and the plurality of external air vents, thereby maintaining the air cavity humidity at the external air humidity.

12. The window unit of claim 11, wherein the plurality of external air vents has a combined area of at least one half square inch per 60 cubic inches of volume in the air cavity, and wherein the plurality of side panel holes, has a combined area of at least one half square inch per 60 cubic inches of volume in the air cavity, and wherein the plurality of air cavity vents, has a combined area of at least one half square inch per 60 cubic inches of volume in the air cavity, and wherein the plurality of passage holes has a combined area of at least one half square inch per 60 cubic inches of volume in the air cavity.

13. The window unit of claim 11, wherein the security panel comprises a high optic architectural grade polycarbonate sheet.

14. The window unit of claim 11, wherein the security panel is secured to the rectangular securing structure by:

(a) a two-sided tape;

(b) a plurality of counter-sunk screws;

(c) a structural sealant caulk; and (d) a trim tab that is affixed to the security panel so as to cover the plurality of counter-sunk screws.

15. The window unit of claim 11, further comprising a desiccant that is disposed in the bottom tubular bar and wherein the bottom tubular defines at least one bottom bar vent so that the desiccant is in fluid communication with the air cavity.

16. The window unit of claim 11, further comprising a plurality of decorative covers that cover each of the plurality of external air vents and each of the plurality of air cavity vents.

17. The window unit of claim 11, wherein at least one of the plurality of external air vents and the plurality of air cavity vents comprises a line of perforations.

* * * * *